US006782873B2

(12) United States Patent
Streib

(10) Patent No.: US 6,782,873 B2
(45) Date of Patent: Aug. 31, 2004

(54) METHOD AND DEVICE FOR THE LOW-EMISSION OPERATION OF A FUEL CELL TANK SYSTEM, ESPECIALLY OF A MOTOR VEHICLE

(75) Inventor: Martin Streib, Vaihingen (DE)

(73) Assignee: Robert Bosch GmbH, Stuttgart (DE)

( * ) Notice: Subject to any disclaimer, the term of this patent is extended or adjusted under 35 U.S.C. 154(b) by 429 days.

(21) Appl. No.: 09/979,107

(22) PCT Filed: Jan. 30, 2001

(86) PCT No.: PCT/DE01/00345

§ 371 (c)(1),
(2), (4) Date: Nov. 19, 2001

(87) PCT Pub. No.: WO01/69072

PCT Pub. Date: Sep. 20, 2001

(65) Prior Publication Data

US 2002/0157655 A1 Oct. 31, 2002

(30) Foreign Application Priority Data

Mar. 17, 2000 (DE) ..... 100 12 778

(51) Int. Cl.[7] ..... F02M 37/04
(52) U.S. Cl. ..... 123/520
(58) Field of Search ..... 123/516, 518, 123/519, 520

(56) References Cited

U.S. PATENT DOCUMENTS 5,146,902 A 9/1992 Cook et al.
5,715,799 A 2/1998 Blomquist et al.
5,739,421 A 4/1998 Iochi et al.
5,873,352 A * 2/1999 Kidokoro et al. ..... 123/520
5,911,209 A 6/1999 Kouda et al.
5,954,034 A 9/1999 Takagi
5,957,115 A 9/1999 Cook et al.
5,975,062 A 11/1999 Bonse et al.
6,192,742 B1 * 2/2001 Miwa et al. ..... 123/520
2001/0003978 A1 * 6/2001 Kitajima et al. ..... 123/520

* cited by examiner

*Primary Examiner*—Thomas N. Moulis
(74) *Attorney, Agent, or Firm*—Walter Ottesen

(57) ABSTRACT

The arrangement for operating a fuel tank system of a motor vehicle includes a pump and valve arrangement (11), an activate charcoal filter (12), a fuel supply tank (14) and a control unit (20). In addition, safety valves (31, 32) as well as a pressure switch (33) are provided. The arrangement (11) includes a de-energized bistable magnetic valve (40) which is connected via a line (41) to the control unit (20) and is driven via a control module (42). The control unit (20) is connected via lines (43, 44) to pressure and/or temperature sensors (45, 46). The pressure sensors (45, 46) supply pressure signals to the control unit (20) via the lines (43, 44). If the control module (42) comes to the result with the evaluation of the pressure/temperature data that, after parking of the vehicle, an overpressure in the fuel supply tank (14) is to be expected compared to the ambient pressure, then the bistable magnetic valve (40) is opened to conduct the excess fuel vapor in correspondence to the flow direction (47) via the active charcoal filter (12) from the supply tank (14) into the ambient of the vehicle. In the case of an underpressure, which is to be expected, the bistable magnetic valve (40) remains, in contrast, closed whereby a tightness check of the fuel tank system can take place via underpressure.

10 Claims, 3 Drawing Sheets

(State of the Art)

(State of the Art)

METHOD AND DEVICE FOR THE LOW-EMISSION OPERATION OF A FUEL CELL TANK SYSTEM, ESPECIALLY OF A MOTOR VEHICLE

FIELD OF THE INVENTION

The present invention relates to control arrangements in general for monitoring the emission of fuel vapors in motor vehicles. The invention especially relates to a method and an arrangement for operating a fuel tank system of a motor vehicle, especially for carrying out a time-to-time tightness check of the fuel tank system wherein an active charcoal filter is provided for taking up gaseous or vaporous fuel formed in the fuel tank system.

BACKGROUND OF THE INVENTION

Present-day combustion-driven motor vehicles mostly include a fuel supply tank as well as a control arrangement for monitoring and, if required, for preventing the emission of fuel vapors formed the fuel supply tank. The control arrangement functions especially for collecting occurring fuel vapor by means of an active charcoal filter and to temporarily store the fuel vapor in the active charcoal filter. Volatile fuel vapors, that is, mostly hydrocarbon vapors, form, for example, during a tanking operation of the vehicle or because of an increasing fuel temperature in the tank and because of an increase of the fuel vapor pressure which is associated therewith.

The storage capacity of the active charcoal filter drops continuously with an increase in the quantity of the stored hydrocarbon and it is therefore necessary to regenerate the active charcoal filter at regular intervals; that is, it is necessary to again remove the stored hydrocarbons from the active charcoal filter. For this purpose, the active charcoal filter is connected via a regeneration valve to an intake manifold of the engine which functions to induct combustion air. By opening the regeneration valve, a pressure drop develops between the active charcoal filter and the intake manifold by means of which the hydrocarbon, which is stored in the active charcoal filter, is conducted into the intake manifold in order to finally be combusted in the engine and thereby be disposed of.

With respect to the foregoing, attention is called to the stricter statutory regulations for the operation of internal combustion engines sought by governments in several countries, such as the United States of America. According to these regulations, it is, for example, required that motor vehicles, in which volatile fuels such as gasoline are used, have control arrangements referred to initially herein which can detect an existing leakage in the tank or in the entire tank-venting system.

A corresponding method and arrangement for diagnosing leaks in fuel tank systems of motor vehicles is suggested in U.S. patent application Ser. No. 10/221,856, filed on Sep. 17, 2002. This application is based on a recognition of pressure changes which are detected by a pressure sensor mounted within the fuel tank and those pressure changes which occur in the blocked fuel tank during a parked phase of the vehicle. In this context, one utilizes especially the underpressure of the tank content which develops with a possible cooling down of the fuel tank. In the case of an existing leak, the pressure increases slowly because ambient air can flow into the tank via the leak. With a simple pressure measurement, the presence of a leak in the tank or in the entire tank system can be determined.

Alternatively, the underpressure can also be generated actively by the internal combustion engine. The tank or the entire fuel tank system is connected to the intake manifold for a short time in a pressure-conducting connection whereby an underpressure, which corresponds to the intake manifold underpressure, develops in the tank. Such a procedure is described, for example, in U.S. Pat. No. 5,957,115.

Furthermore, a method and an arrangement are described in U.S. Pat. No. 5,146,902 wherein, in contrast to the two previous examples, an overpressure is generated in the tank and the drop of the overpressure is checked for leak diagnosis.

In the above-mentioned U.S. patent application Ser. No. 10/221,856, filed on Sep. 17, 2002, it is furthermore described that, with the pressure sensor, also an overpressure, which develops in the case of a warming of the tank content, can be applied correspondingly in the opposite direction for leakage diagnosis. The frequency of defective diagnoses can be reduced by using underpressure and overpressure conditions in the leakage test.

The known tests and arrangements have the disadvantage that an overpressure develops when an untightness or a leak of the fuel tank develops after a warming of the fuel tank and therefore of the tank content which leads to hydrocarbon-containing gas or vapor flowing past the active charcoal filter and into the ambient through the leak. In a motor vehicle, this is especially then the case when this overpressure forms during a parked phase of the vehicle because, in this case, the excess gas or vapor cannot be drawn off by suction actively by means of an engine-driven pump or by an underpressure (for example, via the intake manifold) effected by the engine itself.

The above-mentioned situation, which leads to the overpressure in the fuel tank, can furthermore occur without the described warming of the fuel tank, namely, for example, when the ambient pressure drops because of weather conditions.

SUMMARY OF THE INVENTION

It is a task of the present invention to provide a method and an arrangement as described initially herein which avoid the above disadvantages and which minimize especially the above-mentioned loading of the ambient with hydrocarbons. Furthermore, it should be possible to implement such a method and arrangement as simply as possible and therefore as cost effectively as possible. Especially in view to a use in a motor vehicle, the arrangement should furthermore cause the least possible increase in weight of the fuel tank system.

What is special with respect to the method of the invention is that first a gas-referred or vapor-referred physical state quantity is detected such as the gas pressure or vapor pressure or the gas temperature or the vapor temperature in the interior of the fuel tank system and/or in the vicinity of the vehicle. From the data so obtained, a gas or vapor pressure in the fuel tank system, which is to be expected, is determined. Accordingly, a probable prediction is made as to how the gas or vapor pressure will develop because of the present state quantities, that is, whether an overpressure or an underpressure is to be expected after a pregivable time. In the case of an overpressure of the gaseous or vaporous fuel in the tank system, which is to be expected, compared to the corresponding pressure in the ambient of the vehicle, the gaseous or vaporous fuel is guided out of the fuel tank system via the active charcoal filter into the ambient of the vehicle. In the opposite case of an underpressure, which is to be expected, the fuel tank system or the fuel tank alone is closed off so as to be gas tight or vapor tight, that is, hermetically sealed off in order to make possible especially a tightness check of the fuel tank system by means of the underpressure which is present.

Preferably, and before the above-mentioned method steps have been run, a check is made as to whether parking the vehicle is to be expected. The usual mechanisms for drawing off existing excess fuel gases or vapors cannot be activated because of the engine at standstill. For this reason, a higher risk is present in precisely this situation that hydrocarbons can escape to the outside via a possibly present leak.

To improve the quality of the prediction in connection with the determination of the mentioned pressure conditions, it can be further provided that the particular physical condition quantity, that is, the temperature and/or the pressure, are detected in the fuel tank system as well as also in the ambient of the vehicle. Here, it can be provided that the fuel tank system is only closed off gas tight or vapor tight when a pregivable negative gradient is determined between the outside temperature (temperature outside of the vehicle) and the interior temperature of the fuel tank. In this case, one can expect an underpressure buildup in the fuel tank which effectively prevents an escape of hydrocarbons via a possibly present leak.

Correspondingly, and according to the invention, a gas tight or vapor tight closing of the fuel tank system or of the fuel tank is prevented when a negative pressure gradient between the interior pressure of the tank-venting system or of the fuel tank and the ambient pressure, which is measured outside of the vehicle, is detected or predicted.

Furthermore, a short time span (minimum time) can be pregiven between parking the vehicle and the gas-tight or vapor-tight closing of the fuel tank system. In this way, it can be effectively avoided that an overpressure develops as long as the fuel still vaporizes in the fuel tank because of a previous sloshing of the fuel in the fuel tank.

Correspondingly, a minimum waiting time between a detected tanking operation and the vapor-tight or gas-tight closing of the fuel tank system can be pregiven. A tanking operation can be sensed or detected by a tank cover latch or the like. In this way, it can be avoided that the fuel tank system is closed gas tight or vapor tight too early for very fresh fuel which tends to vaporize intensely and this would likewise lead to a pressure buildup.

The arrangement according to the invention has especially a sensor to detect the above-mentioned physical condition quantity(ies). Furthermore, a computer unit is provided for determining a gas or vapor pressure, which is to be expected, in the fuel tank system while considering the determined condition quantity(ies). In addition, suitable control means are provided for guiding the gaseous or vaporous fuel via the active charcoal filter from the fuel tank system into the ambient of the vehicle and/or for the gas-tight or vapor-tight closure of the fuel tank system, especially for making possible a tightness check of the fuel tank system by means of the underpressure. This control means can include valves, pumps and/or control apparatus usually used in the area of the vehicle manufacture. The implementation can be carried out advantageously by means of slight modifications on an existing program code of a control apparatus or by means of the use in accordance with the invention of known hydraulic components such as pumps, valves or the like.

Preferably, the arrangement of the invention includes means, which coact with the computer unit, for detecting an impending parking of the vehicle. The advantages were already mentioned in the evaluation of the method suggested in accordance with the invention and correspondingly apply here. An impending parking of the vehicle can, for example, be detected or predicted from a switchoff of the engine or, already in advance of switching off the engine, via a switchoff of the vehicle lighting when the darkness of the ambient is detected. The state of the driver door (opening-closing for engine at standstill) can also be applied for making the prediction.

In the arrangement according to the invention, one or several temperature sensors can be provided, which coact with the computer unit and sense the temperature in the fuel tank system and/or the temperature in the ambient of the vehicle. Alternatively or simultaneously, pressure sensors can be provided for detecting pressure in the fuel tank system and/or the pressure in the ambient of the vehicle. As already mentioned, the quality of the prediction can be considerably improved by a pressure and/or temperature detection, which takes place simultaneously inside and outside of the vehicle, and a subsequent gradient formation.

In an especially advantageous embodiment, the arrangement includes a bistable valve mounted between the active charcoal filter and a filter provided for scavenging the active charcoal filter from time to time. The bistable valve is especially a de-energized bistable magnetic valve. A valve of this kind satisfies the above-described requirements according to the invention as to the gas flow control or vapor flow control in an especially efficient manner. In contrast to the magnetic valves used in a manner known per se, which are closed in the de-energized operating state, the valve, which is suggested by the invention, remains de-energized in the particular present open state, that is, either in the closed state or in the open state. A current pulse is needed only to switch over between these two states as well as in the one or in the other direction. This valve is so controlled during a detected parked phase of the vehicle that it only closes off the fuel tank system to the ambient gas tight or vapor tight when the ambient conditions permit the expectation of the development of an underpressure in the tank or in the fuel tank system. In the other cases, however, the valve is opened in order to thereby make possible a pressure compensation between the tank and the ambient unhindered via the active charcoal filter. With this measure, either a pressure drop of an already present overpressure in the fuel tank system or in the tank can take place or can be prevented. An overpressure now develops which would press out the fuel gas or fuel vapor through a possibly present leak.

To achieve a still higher reliability with respect to the escape of hydrocarbons, it can be provided that the valve is opened directly when an overpressure is detected by means of a pressure sensor mounted in the tank interior space in order to effectively prevent a further buildup of pressure.

BRIEF DESCRIPTION OF THE DRAWINGS

The invention will now be described with reference to the drawings, wherein.

DESCRIPTION OF THE PREFERRED EMBODIMENTS OF THE INVENTION

Figure 1:
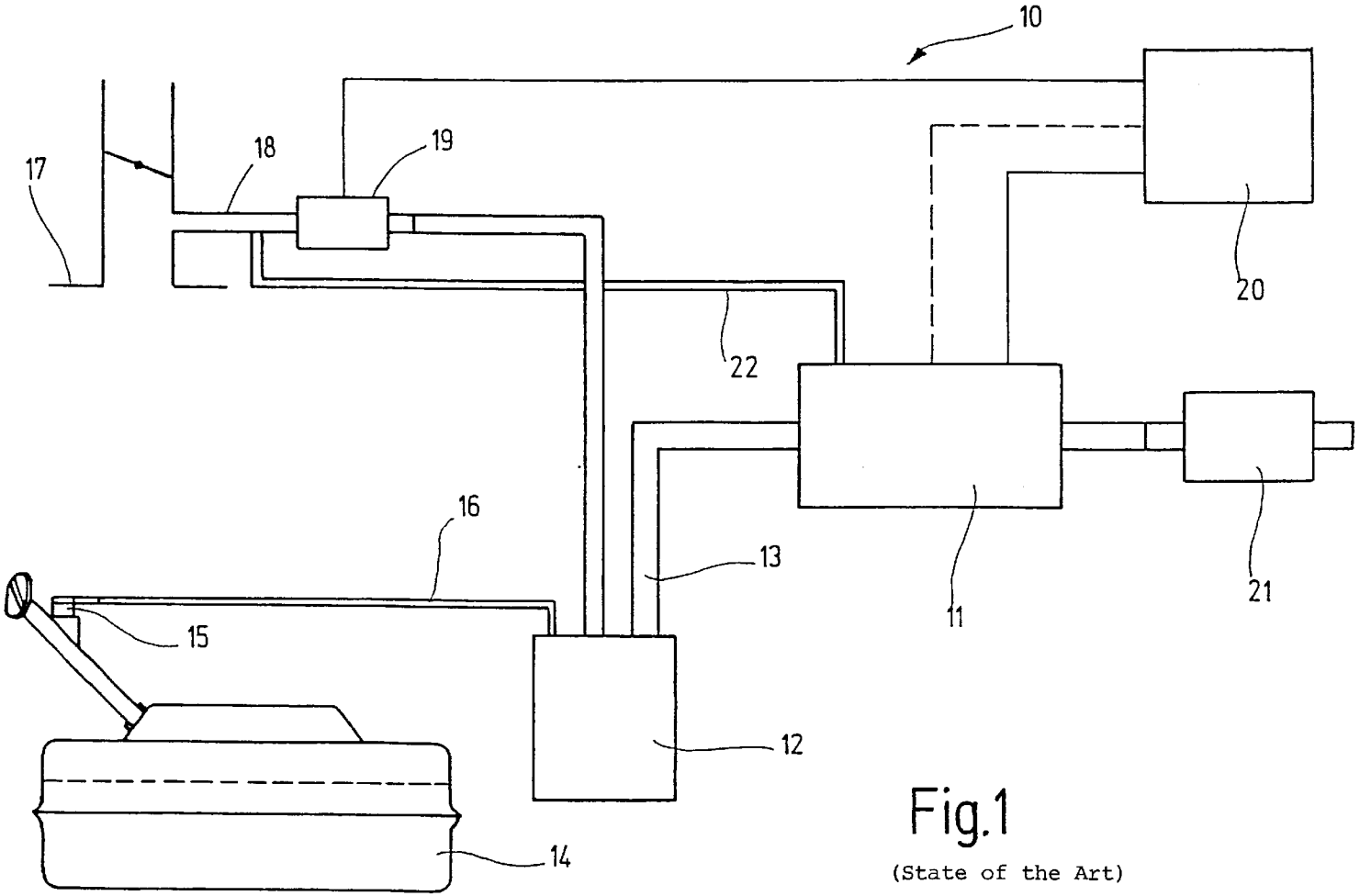
FIG. 1 shows, in schematic representation, a control arrangement for monitoring the emission of fuel vapors in a motor vehicle in accordance with the state of the art.

The schematic block diagram in FIG. 1 shows a control arrangement 10 for monitoring the emission of fuel vapors in a motor vehicle (not shown). The control arrangement 10 is known from the state of the art and includes a pump and valve arrangement 11 for leak diagnosis as well as an active charcoal filter 12. The arrangement 11 and the active charcoal filter 12 are pressure-conductingly connected to each other. A fuel supply tank 14 is connected by means of an overflow and vapor flow control valve 15 and via a pipeline 16 to the active charcoal filter 12. An intake manifold 17 of an internal combustion engine (not shown) is also pressure-conductingly connected to the active charcoal filter 12 via a pipeline 18. The control arrangement includes a regeneration valve 19 in the course of the pipeline 18 in the vicinity of the intake manifold 17. In addition, a control unit 20 is provided which is electrically connected to the pump and valve arrangement 21 and functions to control the arrangement 11 and the regeneration valve 19. Furthermore, the control unit 10 includes a passive filter 21 which pressure-conducting connects the arrangement it to the atmosphere, that is, to the ambient of the vehicle.

Volatile hydrocarbon vapors form in the tank 14 during operation of the vehicle and its internal combustion engine (not shown) or when tanking the fuel supply tank 14. The hydrocarbon vapors enter the charcoal filter 12 via the pipeline 16 and are reversibly bonded in the filter in a manner known per se. The regeneration valve is normally closed. At controlled time intervals, the regeneration valve 19 is so driven by the control unit 20 that a specific partial pressure of the underpressure existing in the intake manifold 17 is supplied to the active charcoal filter 12 which leads to the condition that the stored hydrocarbon vapors are drawn by suction into the intake manifold via the pipeline 18 and the regeneration valve 19 in order to finally be supplied to the engine for combustion and therefore for final disposal. With this procedure of the regeneration of the active charcoal filter 12, fresh air is drawn by suction into the active charcoal filter 12 via the pipeline 13 and the filter 21 whereby the actual scavenging effect is effected.

Figure 2:
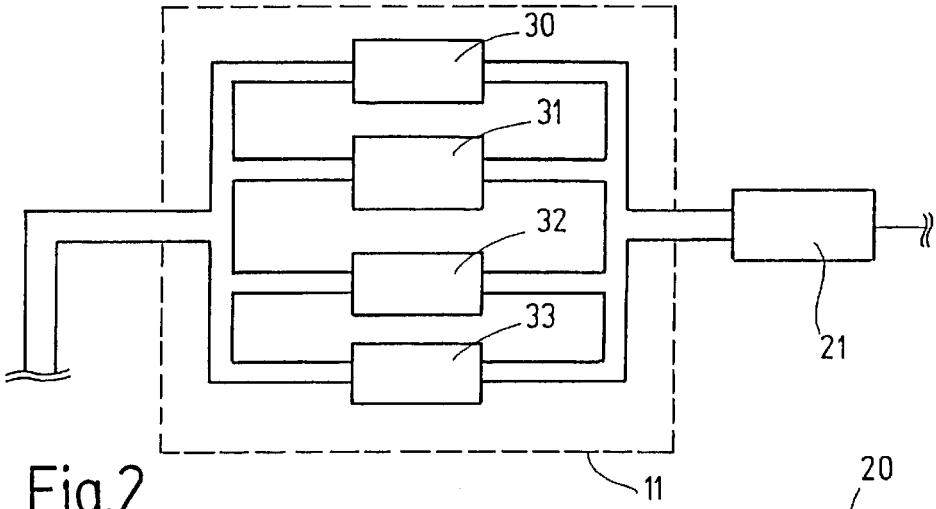
FIG. 2 shows, in a detail enlargement, an embodiment, which is known from the state of the art, of the pump and valve arrangement shown in FIG. 1 for checking tightness with an underpressure technique.

FIG. 2 shows a schematic detail enlargement of an embodiment of the pump and valve arrangement 11 shown already in FIG. 1 which is known in the state of the art. The pump and valve arrangement 11 is in such a configuration wherein a tightness check takes place by means of a natural underpressure method. A magnetic valve 30 is supplied with current only during operation of the motor and is open in order to make available the largest possible line cross section for the scavenging of the active charcoal filter 12. With the switched off engine, the magnetic valve 30 is without current and is closed. Furthermore, passive safety valves "vacuum relief" 31 and "pressure relief" 32 are provided which are closed when there are only slight pressure differences between the fuel tank system (especially the fuel supply tank 14 and the pipeline 16) and the ambient of the vehicle (atmosphere). For this reason, temperature changes in the fuel supply tank 14 can lead to a buildup of an underpressure or an overpressure in the fuel supply tank 14. The passive safety valves 31, 32 open respectively in correspondence to the direction of the existing pressure gradient when there are large pressure differences between the fuel supply tank 14 and the ambient so that a pressure compensation can take place. The overpressure or underpressure which is then present is detected by a pressure switch 33. Details of the leakage test will not be described in more detail here because it is adequately described in the patent literature cited initially herein and is only of secondary importance for the present invention.

Figure 3:
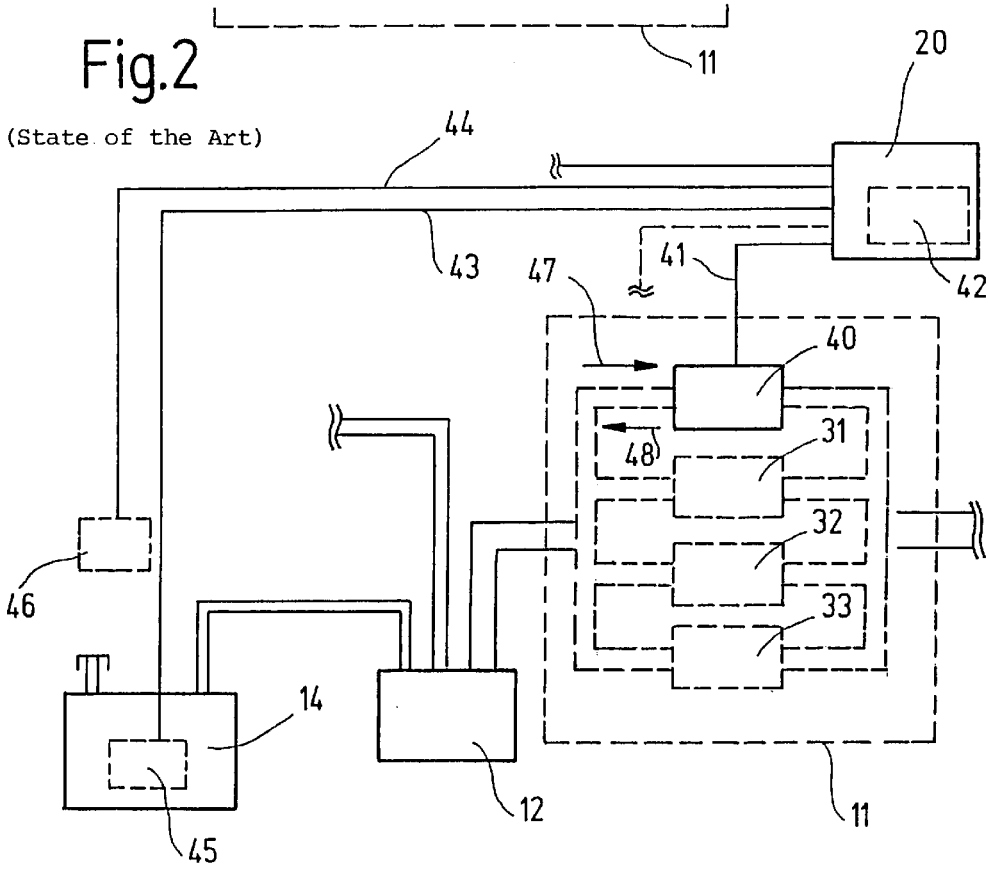
FIG. 3 shows an arrangement according to the invention in a block diagram similar to FIG. 1; and, FIG. 4 shows a flowchart for illustrating a preferred configuration of the method according to the invention.

FIG. 3 shows an arrangement according to the invention in a block diagram presentation similar to that of FIG. 1. In correspondence to the known control unit shown in FIGS. 1 and 2, the arrangement of the invention includes: a pump and valve unit 11, an active charcoal filter 12, a fuel supply tank 14, a control unit 20 as well as corresponding pipelines which are not identified here by reference numerals. According to FIG. 2, the pump and valve unit 11 also includes safety valves 31, 32 as well as a pressure switch 33. In contrast to the arrangement shown in FIGS. 1 and 2, the pump and valve unit 11 includes a de-energized bistable magnetic valve 40 in accordance with the invention. The magnetic valve remains without current in the closed state as well as in the open state. A current pulse is needed only for a switchover between the two states. The bistable magnetic valve 40 is connected via an electrical line 41 to the control unit 20 and is driven via a control module 42, for example, a corresponding program code. The control unit 20 is, in addition, connected via electric lines (43, 44) to a pressure sensor 45 arranged within the fuel tank 14 as well as to a pressure sensor 46 arranged outside of the vehicle. In lieu of the two pressure sensors (45, 46), temperature sensors can be utilized or pressure sensors in combination with temperature sensors can be utilized. The pressure sensors (45, 46) supply pressure signals to the control unit 20 via the lines (43, 44). As soon as the control unit determines an impending park phase of the vehicle via sensors (not shown) or via data transmitted via a CAN bus, the currently present pressure data which is obtained from the pressure signals, is evaluated by means of the control module 42 for the purpose (see also FIG. 4) as to whether, after the parking of the vehicle, an underpressure or an overpressure in the fuel supply tank 14 is to be expected.

In the case that the control module 42 comes to the result when evaluating the pressure data that an overpressure in the fuel supply tank 14 is to be expected compared to the vehicle ambient pressure (atmosphere) after parking the vehicle, the bistable magnetic valve 40 is opened in order to conduct the excess fuel vapor in correspondence to the flow direction 47 via the active charcoal filter 12 out of the fuel supply tank 14 into the ambient of the vehicle. In the case of an underpressure to be expected, the bistable magnetic valve 40 remains, in contrast, closed whereby a tightness check of the fuel tank system can take place by means of an underpressure. It should also be mentioned that fresh air can be conducted into the active charcoal filter 12 in the flow direction 48 in order to carry out the already described scavenging for the purpose of the regeneration of the charcoal filter 12.

Figure 4:
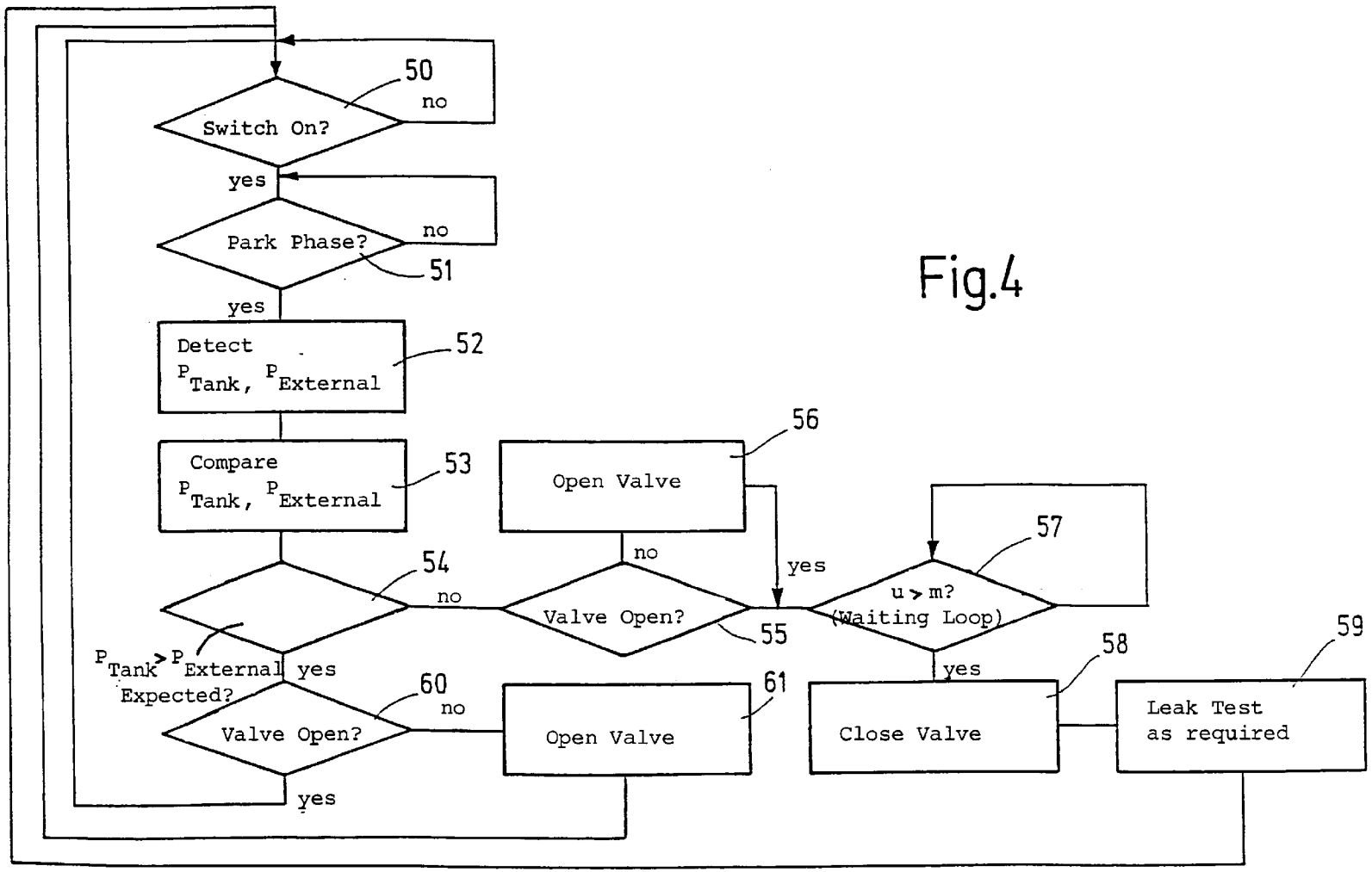

The method according to the invention will now be described in greater detail with respect to the flowchart shown in FIG. 4. First, a check 50 is made as to whether the engine of the vehicle has been switched on. If this is the case, then a further check 51 is made as to whether the vehicle is in a parked phase, that is, whether it can be expected that the vehicle will be switched off (for example, parked). This can take place based on the most different information, for example, as to the state of the engine, the state of the driver door or the like. As soon as it is recognized that a park phase is present, the tank inner pressure and the vehicle outer pressure are detected 52. Alternatively, or in addition, corresponding interior temperatures or exterior temperatures can be detected. The detected pressure data are compared 53 and a prediction is made as to whether a tank inner pressure is expected 54 which is greater than the exterior pressure. If this is not the case, a check 55 is made as to whether the bistable magnetic valve 40 is already open. If this is not the case, the magnetic valve 40 is opened 56 and, thereafter, a waiting loop 57 is run through. With the waiting loop 57, it is avoided that an overpressure develops as long as the fuel still vaporizes because of a previous sloshing of the fuel in the fuel tank. After the waiting loop has been run through, the magnetic valve 40 is closed 58 in order to thereafter carry out a leakage test 59 as may be required.

According to the invention, a leakage test is carried out only in the case of the presence of a pressure drop between the exterior world and the tank interior. Exterior air can possibly flow through the leak into the fuel supply tank. In this way, emissions of fuel vapor can be very effectively prevented. If the tank inner pressure, which is to be expected, is greater than the expected or present ambient pressure, a check 60 is made as to whether the magnetic valve is already open. In the event that it is not, the magnetic valve 40 is opened in order to conduct the excess fuel vapor from the fuel supply tank 14 into the ambient of the vehicle via the charcoal filter 12.

What is claimed is:

1. A method for operating a fuel tank system of a motor vehicle including carrying out a time-to-time tightness check of the fuel tank system, wherein an active charcoal filter is provided for taking up gaseous or vaporous fuel formed in the fuel tank system, the method comprising the steps of:

(a) detecting a parking operation of said motor vehicle;

(b) detecting at least one gas or vapor referenced physical state quantity in the interior of the fuel tank system and in the ambient of the motor vehicle;

(c) predicting a gas or vapor pressure, which is to be expected after said parking operation, in the fuel tank system while considering the difference of the physical state quantity or state quantities determined in step (b); in the case of an overpressure, which is to be expected, including an overpressure of a gaseous or vaporous fuel in the fuel tank system compared to the corresponding pressure in the ambient of the vehicle:

(d1) conducting the gaseous or vaporous fuel via the active charcoal filter out of the fuel tank system into the ambient of the vehicle; and, in the case of an underpressure, which is to be expected, including of the gaseous or vaporous fuel in the fuel tank system compared to the corresponding pressure in the ambient of the vehicle:

(d2) closing off the fuel tank system gas tight or vapor tight, especially for making possible a tightness check of the fuel tank system by means of the underpressure.

2. The method of claim 1, wherein a further step takes place ahead of step (a): detecting an impending parking of the motor vehicle.

3. The method of claim 1, wherein, as a physical state quantity, the temperature in the fuel tank system and/or the temperature in the ambient of the vehicle is or are detected.

4. The method of claim 1, wherein, as physical state quantity, the pressure in the fuel tank system and/or the pressure in the ambient of the vehicle is or are detected.

5. The method of claim 2, wherein a short time span is pregiven between a detected parking of the vehicle or a detected tanking operation of the fuel tank system and the gas tight or vapor tight closing off of the fuel tank system.

6. An arrangement for operating a fuel tank system of a motor vehicle including an arrangement for carrying out a time-to-time tightness check of the fuel tank system, the fuel tank system including an active charcoal filter for taking up gaseous or vaporous fuel formed in the fuel tank system, the arrangement comprising:

at least one sensor for detecting at least one gaseous or vaporous referenced physical state quantity in the interior of the fuel tank system and in the ambient of the motor vehicle;

a computer unit for predicting a gas or vapor pressure, which is to be expected in the fuel tank system after a parking of said motor vehicle, while considering the determined physical state quantity or quantities;

control means for conducting the gaseous or vaporous fuel via said active charcoal filter out of the fuel tank system into the ambient of the vehicle and/or for the gas or vapor tight closing of the fuel tank system including for making possible a tightness check of the fuel tank system by means of the underpressure.

7. An arrangement of claim 6, further comprising means for detecting an imminent parking of the vehicle; and said detecting means operating together with a computer unit.

8. An arrangement of claim 6, further comprising at least one temperature sensor, which operates together with the computer unit, for detecting the temperature in the fuel tank system including in the fuel tank and/or the temperature in the ambient of the vehicle.

9. An arrangement of claim 6, further comprising at least one pressure sensor, which operates together with the computer unit for detecting the pressure in the fuel tank system, including the pressure in the fuel tank and/or the pressure in the ambient of the vehicle.

10. An arrangement of claim 6, further comprising a bistable valve arranged between the active charcoal filter and a filter, which is provided for the time-to-time scavenging of the active charcoal filter, including a currentless bistable magnetic valve to make possible a pressure reduction in the fuel tank system via the filter.

* * * * *

UNITED STATES PATENT AND TRADEMARK OFFICE

CERTIFICATE OF CORRECTION

PATENT NO. : 6,782,873 B2
DATED : August 31, 2004
INVENTOR(S) : Martin Streib

It is certified that error appears in the above-identified patent and that said Letters Patent is hereby corrected as shown below:

Title page,
Item [57], ABSTRACT,
Line 3, delete "activate" and substitute -- active -- therefor.

Column 7,
Line 50, delete "especially" and substitute -- including -- therefor.

Column 8,
Line 28, delete "the" and substitute -- said -- therefor.
Lines 33, 36, 42 and 47, delete "An" and substitute -- The -- therefor.
Line 34, delete "and" and substitute -- and, -- therefor.
Line 38, delete the second "the" and substitute -- said -- therefor.

Signed and Sealed this

Twenty-third Day of November, 2004

JON W. DUDAS
*Director of the United States Patent and Trademark Office*